United States Patent [19]

Mowbray

[11] 4,397,615

[45] Aug. 9, 1983

[54] FUEL INJECTION PUMPING APPARATUS

[75] Inventor: Dorian F. Mowbray, Burnham, England

[73] Assignee: Lucas Industries Limited, Birmingham, England

[21] Appl. No.: 280,124

[22] Filed: Jul. 2, 1981

[30] Foreign Application Priority Data

Jul. 26, 1980 [GB] United Kingdom ..... 8024539
Dec. 31, 1980 [GB] United Kingdom ..... 8041538

[51] Int. Cl.[3] ..... F04B 49/00; F04B 19/22

[52] U.S. Cl. ..... 417/221; 417/462; 123/449; 123/450

[58] Field of Search ..... 417/218, 219, 221, 462; 123/504, 372, 449, 450

[56] References Cited

U.S. PATENT DOCUMENTS 3,861,833 1/1975 Salzgeber et al. ..... 417/462
4,168,690 9/1979 Höfer ..... 123/449
4,292,012 9/1981 Brotherston ..... 417/462
4,358,255 11/1982 Brotherston ..... 417/462

FOREIGN PATENT DOCUMENTS 1776253 6/1975 Fed. Rep. of Germany ..... 417/462

*Primary Examiner*—William L. Freeh
*Assistant Examiner*—Paul F. Neils

[57] ABSTRACT

A fuel injection pumping apparatus comprises an axially movable distributor member the axial setting of which determines the amount of fuel supplied by the apparatus at each pumping stroke. The distributor member is biassed by a spring in one axial direction and is movable in the opposite direction by varying the fluid pressure in a chamber through a port. The port is formed in a sleeve which is coupled to the distributor member by means of a lever and a rod member is axially movable within the sleeve. The axial position of the rod member can be varied to alter the effective size of the port and the distributor member and sleeve move because of the change in pressure in the space. A new equilibrium position is thus established with the distributor member following the movement of the rod member.

5 Claims, 2 Drawing Figures

FUEL INJECTION PUMPING APPARATUS

This invention relates to a fuel injection pumping apparatus for supplying fuel to an internal combustion engine and comprising a body part, a rotary distributor member located in the body, an outwardly extending bore formed in the distributor member and a plunger located therein, means for feeding fuel to said bore to move the plunger outwardly during a filling stroke of the apparatus, a delivery passage communicating with the bore and arranged to register with an outlet port in the body part during a delivery stroke of the apparatus, a cam for imparting inward movement to the plunger to effect delivery of fuel, stop means for limiting the outward movement of the plunger and means for varying the axial setting of the distributor member, said stop means being arranged so that the amount of fuel delivered during the delivery stroke depends upon the axial setting of the distributor member.

The object of the invention is to provide an apparatus of the kind specified in a simple and convenient form.

According to the invention, apparatus of the kind specified comprises resilient means biassing the distributor member in one axial direction, a variable volume chamber defined in part by an outwardly extending face of the distributor member or a part movable therewith, valve means for controlling the pressure of liquid in said chamber thereby to determine the axial setting of the distributor member, said valve means including first and second members movable relative to each other, a variable orifice defined by the members and through which liquid under pressure can flow from said chamber, means for adjusting the axial setting of the first of said members and a linkage extending between the second of said members and the distributor member whereby for a given change in the setting of said first member, the pressure in said chamber will vary and the distributor member will move an amount determined by the change in the setting of said first member.

Figure 1:
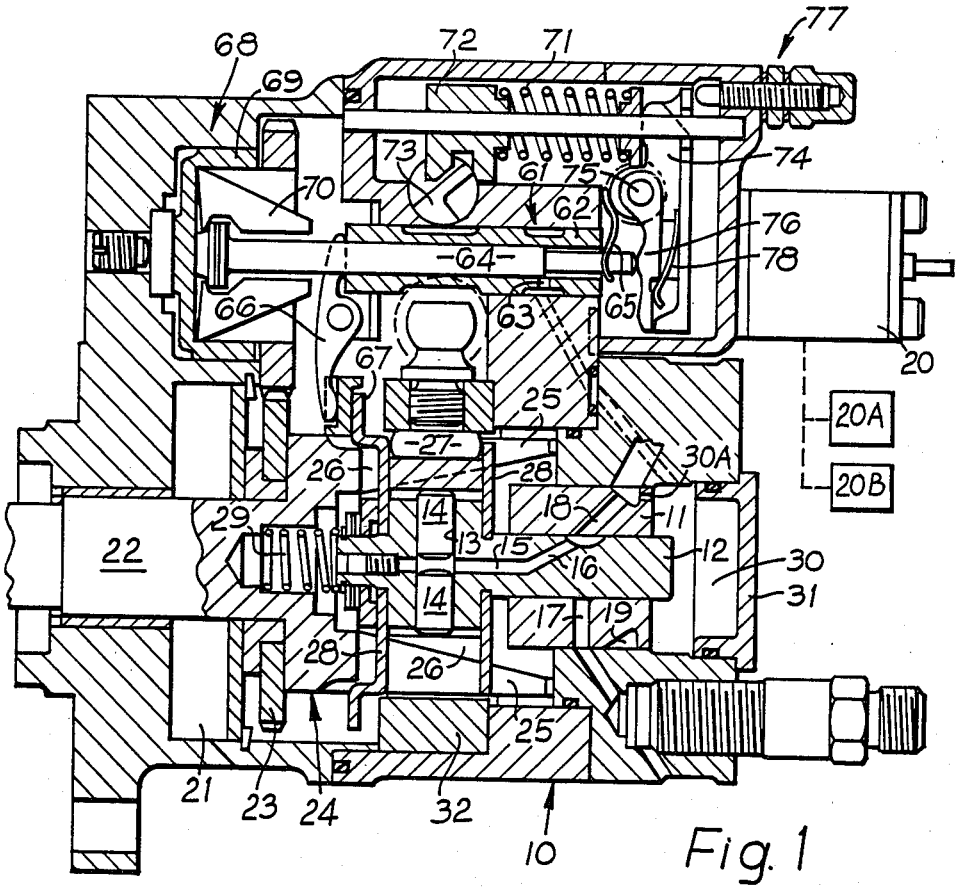
Figure 2:
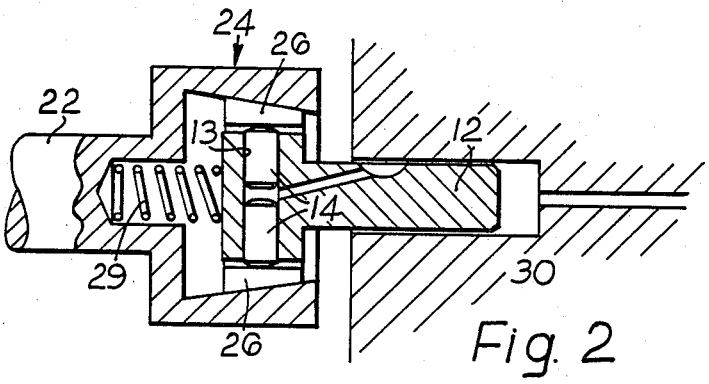

In the accompanying drawings:

FIG. 1 is a sectional side elevation of one example of an apparatus in accordance with the invention and FIG. 2 is a diagrammatic view of a modification of the apparatus of FIG. 1.

Referring first to FIG. 1 of the drawings, the apparatus comprises a multi-part body 10 which includes a sleeve 11 in which is mounted a rotary cylindrical distributor member 12. The distributor member projects from the sleever 11 and is provided with an outwardly extending transverse bore 13 in which is mounted a pair of reciprocable pumping plungers 14. The bore 13 communicates with an axial passage 15 formed in the distributor member and which connects with a delivery passage 16 terminating on the periphery of the distributor member, in an axial groove. The groove registers in turn and as the distributor member rotates with outlet ports 17 only one of which is shown, and which, in use, are connected to the injection nozzles respectively of the associated engine. The aforesaid groove can also register with inlet passages 18 which lie in the same radial plane as the outlet passages 17 and which communicate with a circumferential groove 19 which is formed in the peripheral surface of the sleeve 11 and which communicates by way of an on/off valve 20, with the outlet of a fuel supply pump which is housed in a space indicated at 21 but is shown at 20A. The supply pump draws fuel from a fuel inlet not shown and its output pressure is controlled by a valve 20B.

The rotary part of the supply pump is carried on a drive shaft 22 which is journalled in the body part and which in use is driven from the associated engine. The drive shaft mounts a gear wheel 23 and conveniently a resilient coupling is provided between the wheel and the shaft. The drive shaft includes an enlarged head portion 24 which surrounds the end of the distributor member which projects from the sleeve. The head portion defines a pair of slots 25 in which are located shoes 26 which at their inner ends engage the plungers 14 respectively and which at their outer ends are provided with grooves which carry rollers 27. In addition, located in the slots 25 are drive plates 28 which are connected to the distributor member. The drive plates transmit drive between the drive shaft 22 and the distributor member but at the same time allow axial movement of the distributor member.

The internal surface of the enlarged portion 24 of the shaft is flared outwardly and the shoes 26 are provided with complementary surfaces, said surfaces defining stop means whereby the extent of outward movement of the plungers 14 will depend upon the axial setting of the distributor member. The drive shaft defines a chamber in which is located a coiled compression spring 29 which acts upon the adjacent end of the distributor member to urge it as shown in the drawing, towards the right. A chamber 30 is defined in part by the end surface of the distributor member and in part by a cover 31. A fluid seal is defined between the cover and the body part.

The rollers 27 engage the internal peripheral surface of an angularly adjustable cam ring 32. On the internal peripheral surface of the cam ring are formed pairs of cam lobes which are positioned such that inward movement of the plungers 14 can only take place whilst the groove at the end of the passage 16 is in communication with an outlet. When the groove moves into register with an inlet passage 18, fuel is supplied to the bore 13 and the plungers 14 are moved outwardly, the extent of outward movement being limited by the abutment of the surfaces on the shoes with the flared surface defined by the enlarged portion 24 of the shaft. The axial setting of the distributor member therefore determines the amount by which the plungers 14 can move outwardly and thereby the amount of fuel which is delivered by the apparatus at each delivery stroke. In the example as the distributor member is moved towards the right the quantity of fuel which is delivered increases.

The pressure in the chamber 30 acts upon the distributor member to bias the distributor member against the action of the spring 29. An alternative arrangement is to allow the spring to act at the opposite end of the distributor member and to provide a piston slidable within the chamber which in the example, accommodates the spring 29.

Fuel is admitted to the chamber 30 from the outlet of the supply pump by way of a fixed orifice 30A and the pressure in the chamber 30 is controlled by valve means generally indicated at 61. The valve means comprises a first member in the form of an axially movable rod 64 and a second member in the form of an axially movable sleeve 62, in the wall of which is formed a port 63 communicating with a groove surrounding the sleeve and communicating with the chamber 30. The rod member 64 is provided with a reduced end portion which communicates with a drain. The axial setting of the sleeve 62 corresponds with the axial setting of the distributor member 12 and this is achieved by means of a lever 66 one end of which is forked and acts upon the end of the sleeve 62 whilst the other end mounts a slipper which bears against a flange 67 formed on one of the drive plates 28. In the example as the distributor member is moved towards the left, the sleeve 62 will be moved towards the right and will thereby cause the port 63 to be uncovered and the increased flow of fuel from the chamber 30 will cause a fall in the pressure therein with the result that the spring 29 will move the distributor member towards the right thereby by way of a light spring 65, moving the sleeve 62 towards the left to reduce the size of the port 63. Thus the distributor member will assume a position corresponding to the axial position of the rod member 64. If the rod member is moved towards the right then the port 63 will be covered and the pressure in the chamber 30 will rise thereby causing movement of the distributor member towards the left and movement of the sleeve towards the right, to a new position.

The rod member 64 conveniently forms part of a governor mechanism. This includes a weight unit 68 including a cage 69 having gear teeth engaging with the teeth of the wheel 23. The cage accommodates weights 70 which are engaged with a flange on the rod member 64 whereby as the weights move outwardly under the action of centrifugal force, the rod member 64 will be moved towards the right. This movement is opposed by the action of a governor spring 71 one end of which engages an adjustable abutment 72 the setting of which is determined by an operator adjustable shaft 73. The other end of the spring is operatively engaged with one end of a lever 74 mounted about a pivot 75. The other end of the lever 74 is engaged with a further lever 76 also mounted about the pivot 75, this lever engaging the rod member 64. The arrangement is such therefore that the force exerted by the weights 70 is balanced against the spring 71 so that the rod member 64 assumes a position dependent upon the speed at which the apparatus is driven. If the abutment 72 is moved to vary the force exerted by the spring 71 then the rod member 64 also changes its position and as explained above, so also does the distributor member 12.

As shown in the drawing the rod member 64 is shown in the position which it adopts when the engine is in operation with maximum fuel selected but with the engine not operating at its maximum speed. A maximum fuel stop 77 is engaged by the lever 74 to determine the maximum amount of fuel which can be supplied. In order to start the engine an additional amount of fuel is required and this is provided for by moving the rod an additional amount by means of a leaf spring 78 acting between the levers 74, 76.

The apparatus as described depends for its satisfactory operation upon the output pressure of the supply pump. There is the possibility of a substantial reduction in the output pressure due to failure of part of the pump or the associated relief valve. It is more likely however that the reduction in pressure will be due to a failure in the supply of fuel to the pump due to pipe fracture, or the simple fact that the fuel tank has been allowed to empty and air has been drawn into the pump.

As the output pressure of the low pressure pump falls the overall response of the apparatus and the control system will be to try to maintain the pressure applied to the distributor member. As the output pressure continues to fall a point will be reached at which the pressure applied to the distributor member will fall and as a result movement of the distributor member in the direction to increase the amount of fuel supplied to the engine will take place. Even though the output pressure of the supply pump is reduced there will still be enough pressure to fill the bore 13 with the result that more fuel will be supplied to the engine and the speed of the engine may rise to above its safe speed.

In order to overcome this difficulty the apparatus can be modified as shown in FIG. 2, this Figure showing the essential modifications only. In FIG. 2 identical reference numerals are used and the essential difference in that the co-operating surfaces of the shoes 26 and the enlarged head portion 24 incline in the opposite direction. The effect of this modification is that in order to increase the amount of fuel supplied by the apparatus the pressure in the chamber 30 must be increased and hence if the output pressure of the supply pump should fall then the distributor member will be moved by the spring 29 to reduce the amount of fuel supplied by the apparatus to the associated engine.

As the pressure in the chamber 30 must vary in the opposite manner to that described with reference to FIG. 1, the rod member 64 is modified so that the effective size of the port 63 is reduced as the rod member is moved towards the left and vice-versa. For this purpose the rod member is provided with a circumferential groove which is in constant communication with the drain and the right hand end wall of the groove is utilized to control the effective size of the port 63.

I claim:

1. A fuel injection pumping apparatus for supplying fuel to an internal combustion engine and comprising a body part, a rotary distributor member located in the body part, an outwardly extending bore formed in the distributor member and a plunger means located therein, means for feeding fuel to said bore to move the plunger means outwardly during a filling stroke of the apparatus, a delivery passage communicating with the bore and arranged to register with an outlet port in the body part during a delivery stroke of the apparatus, a cam for imparting inward movement to the plunger means to effect delivery of fuel, stop means for limiting the outward movement of the plunger means, said stop means being arranged so that the amount of fuel delivered during the delivery stroke depends upon the axial setting of the distributor member, resilient means biassing the distributor member in one axial direction, a variable volume chamber defined in part by an outwardly extending face of the distributor member or a part movable therewith, valve means for controlling the pressure of liquid in said chamber thereby to determine the axial setting of the distributor member, said valve means including an axially adjustable rod and a sleeve in which said rod is mounted, said rod and sleeve being movable relative to each other, a variable orifice defined by the rod and sleeve and through which liquid under pressure can flow from said chamber, means for adjusting the axial setting of the rod and a linkage extending between the sleeve and the distributor member, said sleeve being axially movable by said linkage, whereby for a given change in the setting of said rod, the pressure in said chamber will vary and the distributor member will move an amount determined by the change in the setting of said rod.

2. An apparatus according to claim 1 in which said linkage comprises a lever mounted about a pivot disposed intermediate its ends, one end of said lever engaging said sleeve and the other end of said lever being operatively connected to a part movable with the distributor member.

3. An apparatus according to claim 2 in which said part comprises a flange which rotates with and is axially movable with the distributor member, said other end of the lever mounting a slipper for engagement with said flange.

4. An apparatus according to claim 3 including resilient means biassing said sleeve into contact with said one end of the lever and the slipper into contact with said flange.

5. An apparatus according to claim 1 in which said rod at one end is engaged by a centrifugal weight the force exerted by the weight being opposed by the action of governor spring means.

* * * * *